US008002430B2

(12) United States Patent
Kennedy et al.

(10) Patent No.: US 8,002,430 B2
(45) Date of Patent: Aug. 23, 2011

(54) CONFIGURABLE INTERIOR AND/OR EXTERIOR PORTABLE ARTICLE ILLUMINATION SYSTEM

(75) Inventors: Greg Kennedy, Moab, UT (US); Douglas Kennedy, Moab, UT (US)

(73) Assignee: Tactical Lighting Solutions, LLC, Moab, UT (US)

( * ) Notice: Subject to any disclaimer, the term of this patent is extended or adjusted under 35 U.S.C. 154(b) by 344 days.

(21) Appl. No.: 12/425,930

(22) Filed: Apr. 17, 2009

(65) Prior Publication Data

US 2010/0264854 A1 Oct. 21, 2010

(51) Int. Cl.
*A45C 15/06* (2006.01)

(52) U.S. Cl. ..... 362/156; 362/154; 362/278; 362/320; 206/373; 206/780; 206/783

(58) Field of Classification Search ..... 362/101, 362/154, 156, 278, 283, 320, 321; 206/216, 206/373

See application file for complete search history.

(56) References Cited

U.S. PATENT DOCUMENTS

| | | | | |
|---|---|---|---|---|
| 3,808,416 | A * | 4/1974 | Pottratz | 362/156 |
| 5,073,844 | A | 12/1991 | Coyner et al. | |
| 5,836,671 | A | 11/1998 | Chien | |
| 5,934,790 | A | 8/1999 | Quintana et al. | |
| 6,152,572 | A | 11/2000 | Cutler | |
| 6,824,291 | B2 | 11/2004 | Vautrin et al. | |
| 7,055,978 | B2 | 6/2006 | Worthington | |
| 7,086,751 | B2 * | 8/2006 | Clark | 362/154 |
| 7,246,915 | B2 | 7/2007 | Verona | |
| 7,270,438 | B2 | 9/2007 | Chen | |
| 7,347,235 | B2 | 3/2008 | Beverly | |
| 7,347,577 | B1 | 3/2008 | Rapisarda | |
| 2005/0270764 | A1 | 12/2005 | Kurcz et al. | |
| 2007/0153503 | A1 | 7/2007 | Feng | |
| 2008/0019120 | A1 | 1/2008 | Rapisarda | |
| 2008/0037242 | A1 | 2/2008 | Long et al. | |
| 2008/0151530 | A1 | 6/2008 | Rapisarda | |
| 2008/0180940 | A1 | 7/2008 | Tuan | |

FOREIGN PATENT DOCUMENTS

| | | |
|---|---|---|
| AT | 504059 | 2/2008 |
| FR | 2886523 | 12/2006 |
| WO | WO2007081066 | 7/2007 |

* cited by examiner

*Primary Examiner* — Stephen F Husar

(74) *Attorney, Agent, or Firm* — Baker & Associates PLLC; Trent H. Baker

(57) ABSTRACT

One embodiment relates to a portable article illumination system with an enclosure disposed between openings in the interior and external surfaces of a portable article. A removable illumination device may be disposed within the enclosure such as a selectably engageable portable lighting device. The interior and exterior openings may each be substantially covered by transparent and opaque members respectively. The transparent members cover the interior and exterior openings and are disposed proximal to the enclosure with respect to the opaque members. The transparent members may further provide optical pathways between the enclosure and the interior and/or exterior region. The opaque members substantially cover the transparent members thereby optically obstructing the optical pathways which extend from the enclosure through the corresponding transparent member to the interior or exterior region. The opaque members are selectively passable to selectively unobstruct the respective optical pathways between the enclosure and the interior or exterior region.

20 Claims, 6 Drawing Sheets

CONFIGURABLE INTERIOR AND/OR EXTERIOR PORTABLE ARTICLE ILLUMINATION SYSTEM

FIELD OF THE INVENTION

The invention generally relates to illumination systems on portable articles having a substantially enclosed interior region. In particular, the present invention relates to an illumination system which may be selectively configured to illuminate an exterior and/or interior region of a portable item.

BACKGROUND OF THE INVENTION

Illumination systems provide a region or field of illumination that may be used for a variety of purposes. The illuminated region may be used to provide visual light to allow a user to perform tasks or designate a particular location for others. For example, a headlamp is an illumination system which is commonly used to visibly illuminate a region in front of a user for purposes of walking at night. Likewise, a flashlight is a handheld illumination system which illuminates a region for a variety of purposes. Both headlamps and flashlights are sized to be portable to allow users to bring them to a variety of locations.

Portable articles containing enclosed interior regions include bags, backpacks, luggage, tents, clothing, etc. One of the problems associated with performing tasks within the enclosed interior regions of these portable articles is the lack of visible light. For example, the interior of a bag may be visibly dark, thereby preventing a user from identifying and/or manipulating the contents of the interior region. Conventional portable illumination systems are not always available and often fail to properly illuminate the interior enclosed region in a manner that also facilitates effective operation. For example, a flashlight or headlamp may be located within the visibly dark enclosed internal region of backpack. Likewise, portable illumination systems are used on the exterior of portable articles for a variety of reasons including increasing visibility and/or signaling. For example, urban cyclists often attach illumination devices to the external region of a backpack to increase their visibility to motorists at night.

Attempts have been made to adapt existing portable illumination systems for use in illuminating either the exterior or interior region of an article. For example, a headlamp or light wand may be directly attached to the exterior or internal surface of a portable article to facilitate direct illumination of the corresponding region. Unfortunately, this direct coupling scheme fails to provide a system that both illuminates the necessary region and facilitates efficient user operation. For example, directly coupling a headlamp to the interior region of a backpack may provide the proper illuminated region but may not be accessible for a user to initially turn on in a dark environment. Likewise, directly coupling a light wand to the exterior of a tent may be externally accessible for switching on and off, but is paradoxically not able to illuminate the interior region of the tent. Various complex user operation switching systems are also ineffective because they diminish the portability and simplicity of both the illumination system and the article to be illuminated.

Therefore, there is a need in the industry for a selectively configurable interior and/or exterior portable article illumination system.

SUMMARY OF THE INVENTION

The present invention relates to illumination systems on portable articles having a substantially enclosed interior region. One embodiment of the present invention relates to a portable article including an illumination system which may be selectively configured to illuminate the exterior and/or interior regions of the portable article. The illumination system of the portable article may include an enclosure disposed between openings in the interior and external surfaces of an encasement member of the portable article. A removable illumination device may be disposed within the enclosure such as a selectably engageable portable lighting device. The interior opening is adjacent to the interior region and the exterior opening is adjacent to the exterior region of the portable article, respectively. The interior and exterior openings may each be substantially covered by transparent and opaque members respectively. The transparent members cover the interior and exterior openings and are disposed proximal to the enclosure with respect to the opaque members. The transparent members may further provide optical pathways between the enclosure and the interior and/or exterior regions. The opaque members substantially cover the transparent members, thereby optically obstructing the optical pathways which extend from the enclosure through the corresponding transparent member to the interior or exterior region. The opaque members are selectively passable to selectively unobstruct the respective optical pathways between the enclosure and the interior or exterior region. The transparent members may also be selectively passable to facilitate direct physical access to the enclosure. A second embodiment of the present invention relates to a method of selectively illuminating the interior and/or exterior region of a portable article.

Embodiments of the present invention represent a significant advance in the field of illumination systems on portable articles having an enclosed interior region. Prior art illumination systems fail to provide efficient selectable interior and/or exterior illumination. Embodiments of the present invention overcome the limitations of prior art schemes by providing a system that can selectively illuminate one or both of the interior and exterior of a portable article in a manner that is both accessible and reliable for a user to operate in a visually dark environment. For example, a backpack user may externally activate an illumination device disposed within an enclosure and release the internally oriented opaque member, thereby illuminating the interior substantially encased region of the backpack via the optical pathway from the illumination device through the internally oriented transparent member. Likewise, the user may selectively release the externally oriented opaque member to illuminate an exterior region via the optical pathway from the illumination device through the externally oriented transparent member.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1A:
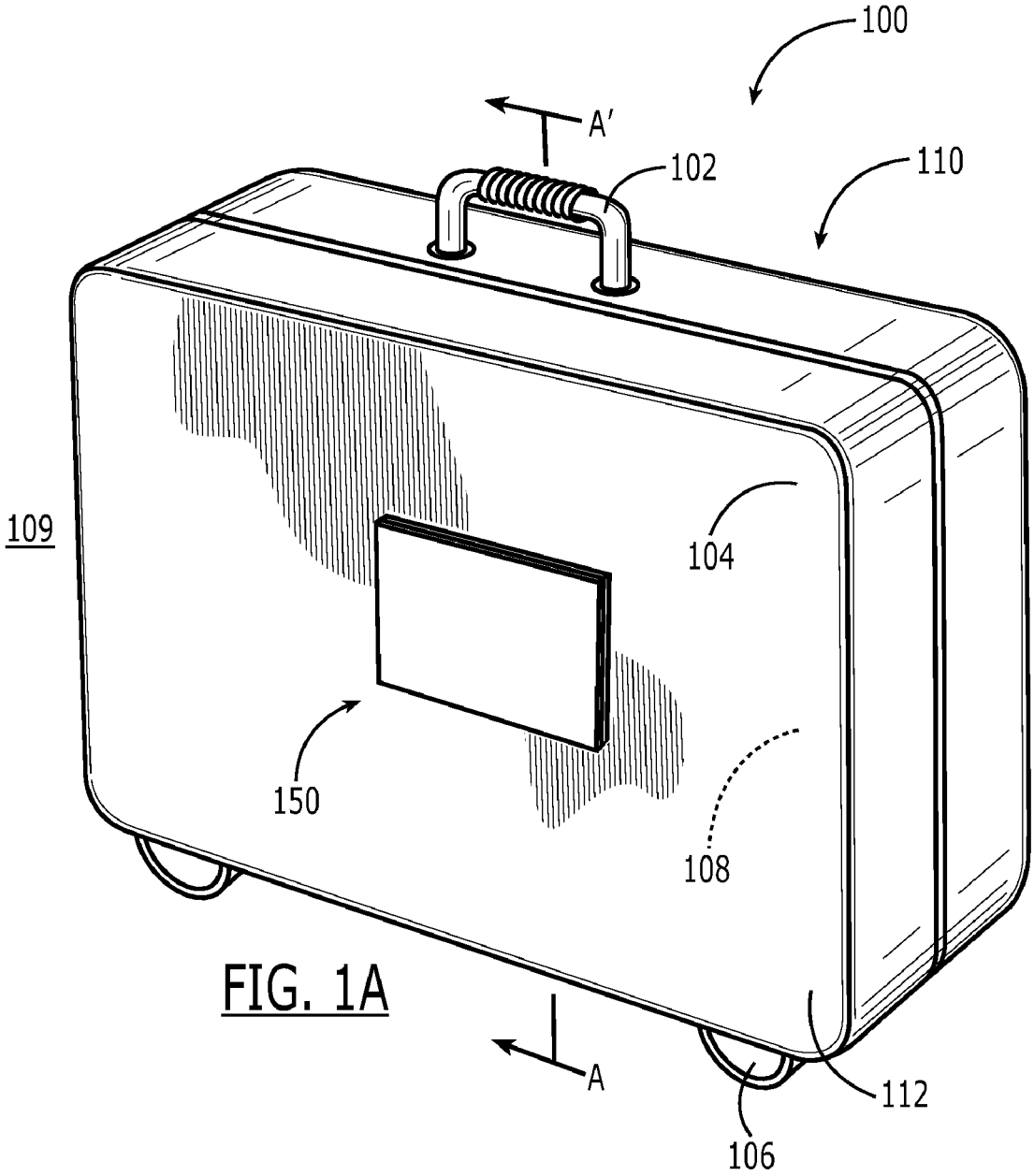
FIG. 1A illustrates a profile view of a portable article with an interior/exterior illumination system in accordance with embodiments of the present invention.

The present invention relates to illumination systems on portable articles having a substantially enclosed interior region. One embodiment of the present invention relates to a portable article including an illumination system which may be selectively configured to illuminate the exterior and/or interior regions of the portable article. The illumination system of the portable article may include an enclosure disposed between openings in the interior and external surfaces of an encasement member of the portable article. A removable illumination device may be disposed within the enclosure such as a selectably engageable portable lighting device. The interior opening is adjacent to the interior region and the exterior opening is adjacent to the exterior region of the portable article respectively. The interior and exterior openings may each be substantially covered by transparent and opaque members respectively. The transparent members cover the interior and exterior openings and are disposed proximal to the enclosure with respect to the opaque members. The transparent members may further provide optical pathways between the enclosure and the interior and/or exterior region. The opaque members substantially cover the transparent members thereby optically obstructing the optical pathways which extend from the enclosure through the corresponding transparent member to the interior or exterior region. The opaque members are selectively passable to selectively unobstruct the respective optical pathways between the enclosure and the interior or exterior region. The transparent members may also be selectively passable to facilitate direct physical access to the enclosure. A second embodiment of the present invention relates to a method of selectively illuminating the interior and/or exterior region of a portable article. Also, while embodiments are described in reference to an illumination system for portable articles having an interior region, it will be appreciated that the teachings of the present invention are applicable to other areas.

The following terms are defined as follows:

Portable article—an article or object with a form factor that enables reasonable portability by a user in any configuration. For example, a tent is a portable article because it is configured to be carried or ported by a user in a collapsed or compressed state. Likewise, a backpack and a suitcase are also portable articles because they are configured to be carried or ported by a user during movement. In addition, a portable article may be further classified as a portable article that substantially encases an internal region. For example, the shell of a tent substantially encloses an internal region within which a user may sleep. Likewise, a backpack or suitcase substantially encloses an internal region within which items may be stored.

Encasement member—a material substantially encasing an internal region.

Enclosure—a region substantially enclosed by one or more surfaces.

Selective passability—an item may be selectively passable to selectively provide some form of pathway through or around the item. For example, a file cabinet shell encloses an internal region but is selectively passable via a drawer which when selectively opened provides access to the internal region either through or around the drawer. In addition, different forms of selective passability may include both optical passability and physical penetrability. Various forms of selective passability schemes may include but are not limited to internal selectively exposed recesses and partial releasable couplings.

Reference is initially made to FIGS. 1A-G, which illustrate views of a portable article with an interior/exterior illumination system, designated generally at 100. The illustrated portable article 100 may commonly be referred to as a suitcase, case, or briefcase. It will be appreciated that this particular portable article is selected for illustrative purposes, and embodiments of the present invention may be applied to any portable article that substantially encases an internal region including but not limited to any form of luggage, case, backpack, tent, canopy, etc. FIG. 1A particularly illustrates a profile view of the portable article 100. The illustrated portable article 100 comprises a handle 102, an encasement member 104, an interior region 108 (not visible), an external region 109, a set of wheels 106, and an illumination system 150. The encasement member 104 substantially encases the interior region 108 from the exterior region 109. The encasement member 104 includes an internal surface 114 adjacent to the interior region 108 and an external surface 112 opposite to the interior region 108. The exterior region 109 is the three dimensional space externally surrounding the portable article 109. The external surface 112 of the encasement member 104 is therefore adjacent to the exterior region 109. The handle 102 is disposed on the top portion of the portable article opposite the wheels 106 to facilitate user elevation and transportation above a supportive surface. The illumination system 150 is one embodiment of a system that enables selective illumination of the interior region 108 and/or the exterior region 109 of the portable article 100. The line A'-A defines a cross-sectional region across which FIGS. 1B-G are illustrated.

FIGS. 1B-G illustrate cross sectional views of the portable article 100 including various different operational states of the illumination system 150. The cross sectional views further illustrate the internal surface 114 of the encasement member 104 substantially encasing the interior region 108. Likewise, the external surface 112 is oppositely oriented so as to be adjacent to the exterior region 109. The illustrated illumination system 150 includes an enclosure 156 between an interior opening 163 and an exterior opening 163 of the encasement member 104. The interior opening 163 is a recess formed within the surface area of the internal surface 114 and the exterior opening 153 is a recess formed within the surface area within the external surface 112. The interior opening 163 is substantially covered by a first transparent member 164 and a first opaque member 162. The first transparent member 164 is disposed between the interior opening 163 and the first opaque member 162. The first transparent member 164 may optically cover or obstruct the interior opening 163 such that an interior optical pathway 172 between the enclosure 156 and the interior region 108 must transmit through the first transparent member 164. The first opaque member 162 optically obstructs or covers the first transparent member 164, thereby optically obstructing the interior optical pathway 172 between the enclosure 156 and the interior region 108. Likewise, the exterior opening 153 is substantially covered by a second transparent member 154 and a second opaque member 152. The second transparent member 154 is disposed between the exterior opening 153 and the second opaque member 152. The second transparent member 154 may optically cover or obstruct the exterior opening 153 such that an exterior optical pathway 174 between the enclosure 156 and the exterior region 109 must transmit through the second transparent member 154. The second opaque member 152 optically obstructs or covers the second transparent member 154, thereby optically obstructing the exterior optical pathway 174 between the enclosure 156 and the exterior region 109.

The first and second opaque members 162, 152 may be selectively passable to optically unobstruct the interior and exterior optical pathway 172, 174 that transmits through the first and second transparent members 164, 154 between the enclosure 156 and the interior and exterior regions 108, 109 respectively. The selective penetrable configuration may include one of selectively exposed recesses and partial releasable couplings. The selectively exposed recesses may include various selectable opening schemes including but not limited to a zipper, overlapping portions, drawstring closures, VELCRO, and/or an opening within the surface area of the opaque member to facilitate the optical penetration. In addition, a portion of the respective opaque member may be releasably coupled to the underlying transparent member to enable the optical passage via partial disengagement and articulation. Likewise, the first and second transparent members 164, 154 may be selectively passable to provide physical pathways to the enclosure 156 from the interior and exterior regions 108, 109. Naturally, the physical pathways to the enclosure 156 must also be coordinated with the selective passage of the opaque members 162, 164.

The first and second opaque members 162, 152 may include an interior surface adjacent to the respective transparent member 164, 154 and an exterior surface adjacent to the interior/exterior region 108, 109. The interior surface of the opaque members 162, 152 may include an optically reflective surface including but not limited to a yellow or mirrored coating. The optically reflective surface would thereby reflective optical output from the removable illumination device 170 to intensify the transmission of optical output through opposite transparent member. For example, a reflective coating in the interior surface of the first opaque member 154 would intensify the optical output of the removable illumination device 170 through the second transparent member 164 and the exterior optical pathway 174 (configuration illustrated in FIG. 1D).

The first and second transparent members 152, 154 may include particular optical coatings to alter the light transmission therethrough. In addition, the transparent members 152, 154 may include phosphorescent or inherent material based illumination properties. For example the transparent members 152, 154 may be configured to produce chemical illumination independent of the illumination device 170. Various types of optical coatings and/or materials may be utilized to achieve optical effects, including but not limited to spectral filtration, correlation, geometrical restriction, filtration, polarization, illumination, phosphorescence, etc.

A removable illumination device 170 is disposed within the enclosure 156. Various forms of removable illumination devices may be utilized including but not limited to both electrical and chemical self-contained type illumination systems. The illustrated removable illumination device 170 is selectively engageable to an on state which corresponds with transmitting an optical output. Various switching mechanisms and optical output specifications may be utilized including both visible and infrared type optical outputs. The illustrated optical output from the device 170 is spectrally oriented to transmit to one or both of the interior and exterior regions 108, 109 via unobstructed optical pathways. The optical output may include both visible and non-visible optical transmission.

Figure 1B:
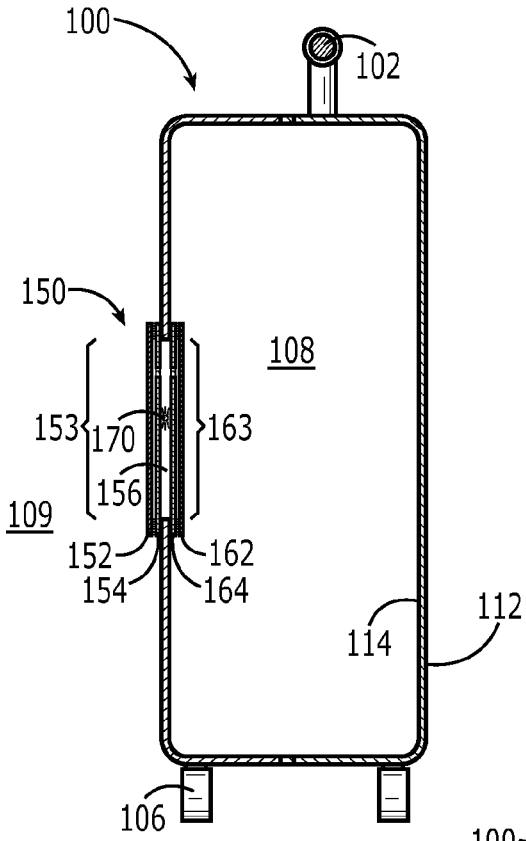
FIG. 1B illustrates a cross sectional view of the portable article of FIG. 1A along the lines A'-A and further illustrating the interior/exterior illumination system in a covered state.

FIG. 1B particularly illustrates the illumination system 150 in a covered state in which the interior optical pathway 172 and exterior optical pathway 174 are optically obstructed by the first and second opaque members 162, 164. The first and second opaque members 162, 164 optically cover the first and second transparent members 152, 154 and therefore are not optically passable in this configuration.

Figure 1C:
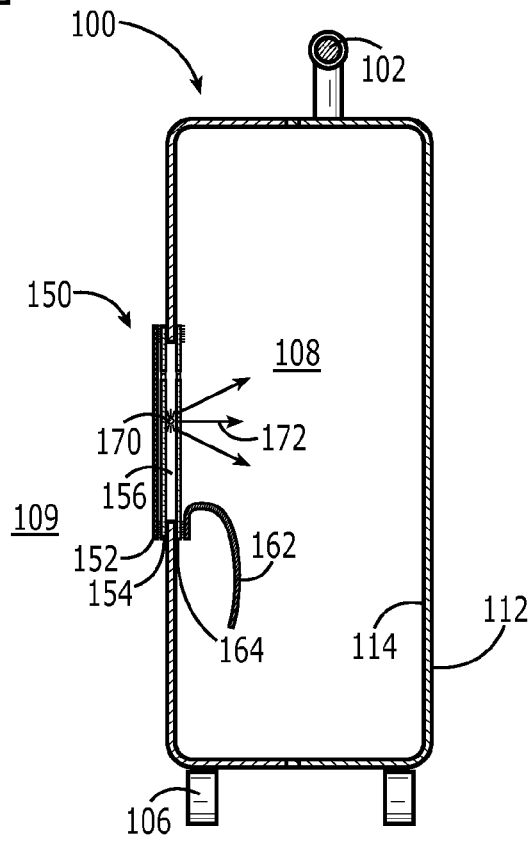
FIG. 1C illustrates a cross sectional view of the portable article of FIG. 1A along the lines A'-A and further illustrating the interior/exterior illumination system in an internally illuminated state.

FIG. 1C particularly illustrates the illumination system 150 in an internally illuminated state in which an interior optical pathway 172 from the removable illumination device 170 to the interior region 108 is unobstructed, thereby allowing an optical output from the removable illumination device 170 to transmit through the first transparent member 164 to the interior region 108. The selective passability scheme of the first opaque member 162 is selected thereby, optically unobstructing the interior optical pathway 172 via partially releasing/disengaging the first opaque member 162 from the first transparent member 164 via articulating and/or folding. The partial release of the first opaque member 162 may include releasing from the first transparent member 164 and/or the interior opening 163. Alternatively, an internal recess (not shown) disposed on the first opaque member 162 could be selectively opened to optically unobstruct the interior optical pathway 172. The selective opening of the internal recess may include various opening schemes including but not limited to manually separating a slit recess, opening a zipper, disengaging a VELCRO region, and/or disengaging a releasably buttoned region.

Figure 1D:
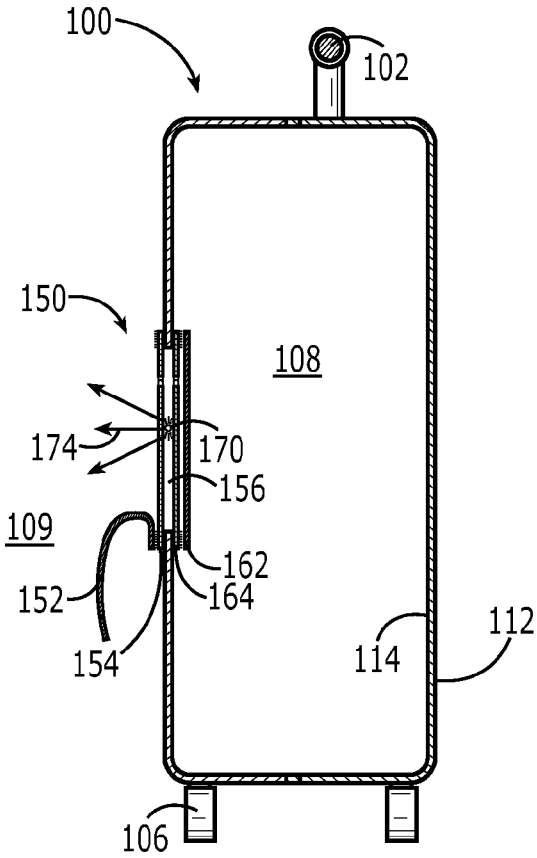
FIG. 1D illustrates a cross sectional view of the portable article of FIG. 1A along the lines A'-A and further illustrating the interior/exterior illumination system in an externally illuminated state.

FIG. 1D particularly illustrates the illumination system 150 in an externally illuminated state in which an exterior optical pathway 174 is unobstructed, thereby allowing an optical output from the removable illumination device 170 to transmit through the second transparent member 154 to the exterior region 109. The selective passability scheme of the second opaque member 152 is selected, thereby optically unobstructing the exterior optical pathway 174 via partially releasing/disengaging the second opaque member 152 from the second transparent member 154 via articulating and/or folding. The partial release of the second opaque member 152 may include releasing from the second transparent member 154 and/or the exterior opening 153. Alternatively, an internal recess (not shown) disposed on the second opaque member 152 could be selectively opened to optically unobstruct the interior optical pathway 174. The selective opening of the internal recess may include various opening schemes including but not limited to manually separating a slit recess, opening a zipper, disengaging a VELCRO region, and/or disengaging a releasably buttoned region.

Figure 1E:
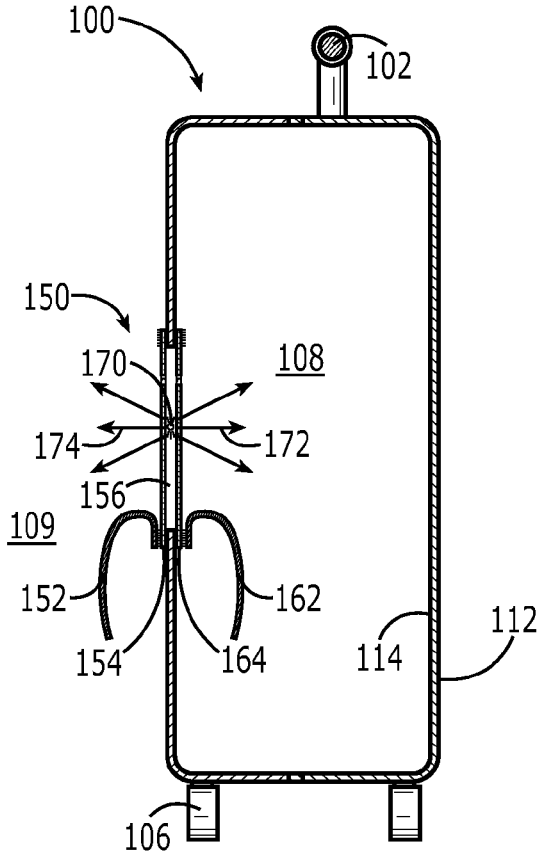
FIG. 1E illustrates a cross sectional view of the portable article of FIG. 1A along the lines A'-A and further illustrating the interior/exterior illumination system in an internally and externally illuminated state.

FIG. 1E particularly illustrates the illumination system 150 in an internally and externally illuminated state in which both the interior and exterior optical pathways 172, 174 are unobstructed thereby allowing an optical output from the removable illumination device 170 to transmit through the first and second transparent members 164, 154 to the interior and exterior regions 108, 109.

Figure 1F:
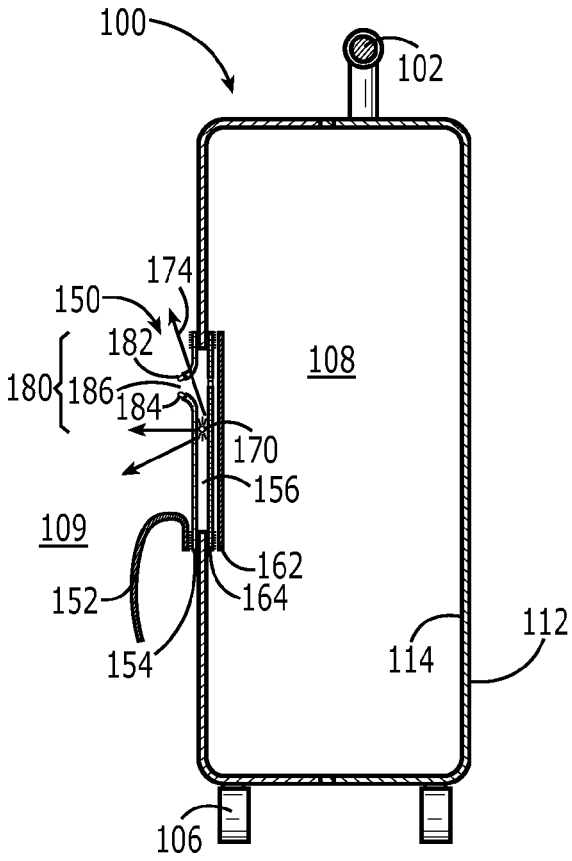
FIG. 1F illustrates a cross sectional view of the portable article of FIG. 1A along the lines A'-A and further illustrating the interior/exterior illumination system in an externally illuminated and externally physically accessible state.

FIG. 1F particularly illustrates the illumination system 150 in an externally illuminated and externally physically accessible state. The external physical accessibility is via a physical pathway from the exterior region 109 through and/or around the second opaque member 152 and the second transparent member 154. In addition, the exterior optical pathway 174 is unobstructed, thereby allowing an optical output from the removable illumination device 170 to transmit through the second transparent member 154 to the exterior region 109. As discussed above, the illustrated selected passage of the second opaque member 152 includes a partial release and articulation. The illustrated selected passage of the second transparent member 154 occurs via a selectively exposed second recess scheme 180. The selectively exposed second recess scheme 180 includes a second recess 184 within the surface area of the second transparent member 154. The illustrated second recess 184 is between second segments 182, 184 of the second transparent member 154. It will be appreciated that the selectable passage schemes of the second opaque and transparent members 152, 154 may be replaced by alternative schemes and remain consistent with the present invention. For example, the second transparent member 154 may alternatively be released and folded in a manner similar to the second opaque member 152 to provide the physical pathway to the exterior region 109. The physical pathway from the exterior region 109 to the enclosure 156 enables a user to perform functions related to the removable illumination device 170 including but not limited to initial placement, removal, activation, deactivation, selective operation, power source replacement, orientation, etc. For example, a user may selectively articulate the second opaque member 152 to unobstruct the second transparent member 154; selectively open the second recess 180 on the second transparent member 154; and initially place the removable optical illumination device 170 within the enclosure to illuminate the exterior region 109.

Figure 1G:
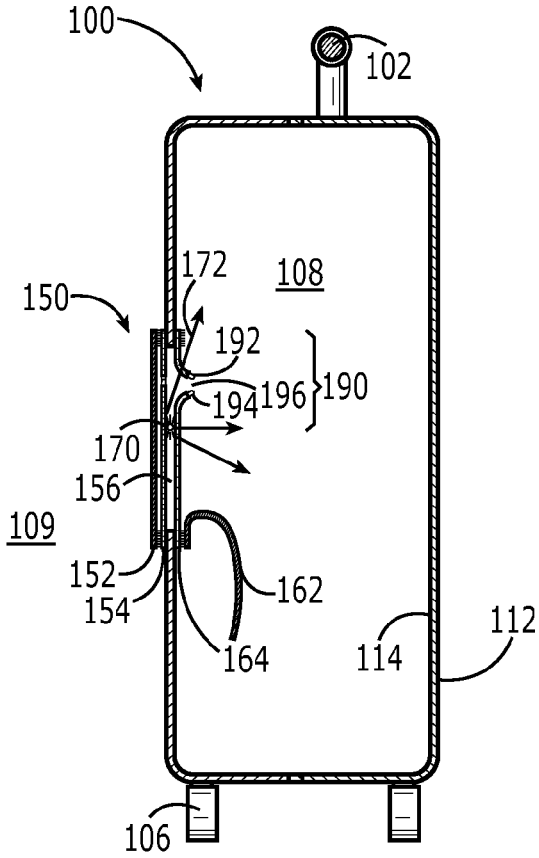
FIG. 1G illustrates a cross sectional view of the portable article of FIG. 1A along the lines A'-A and further illustrating the interior/exterior illumination system in an internally illuminated and internally physically accessible state.

FIG. 1G particularly illustrates the illumination system in an internally illuminated and internally physically accessible state. The internal physical accessibility is via a physical pathway from the interior region 108 through and/or around the first opaque member 162 and the first transparent member 164. In addition, the interior optical pathway 172 is unobstructed, thereby allowing an optical output from the removable illumination device 170 to transmit through the first transparent member 164 to the interior region 108. As discussed above, the illustrated selected passage of the first opaque member 162 includes a partial release and articulation. The illustrated selected passage of the first transparent member 164 is via a selectively exposed first recess scheme 190. The selectively exposed first recess scheme 190 includes a first recess 194 within the surface area of the first transparent member 164. The illustrated first recess 194 is between first segments 192, 194 of the first transparent member 164. It will be appreciated that the illustrated selectable passage schemes of the second opaque and transparent members 162, 164 may be replaced by alternative schemes and remain consistent with the present invention. For example, the first transparent member 164 may alternatively be released and folded in a manner similar to the first opaque member 162 to provide the physical pathway to the interior region 108. The physical pathway from the interior region 108 to the enclosure 156 enables a user to perform functions related to the removable illumination device 170, including but not limited to initial placement, removal, activation, deactivation, selective operation, power source replacement, orientation, etc. For example, a user may selectively articulate the first opaque member 162 to unobstruct the first transparent member 164; selectively open the first recess 190 on the first transparent member 164; and initially place the removable optical illumination device 170 within the enclosure to illuminate the interior region 108.

Figure 1H:
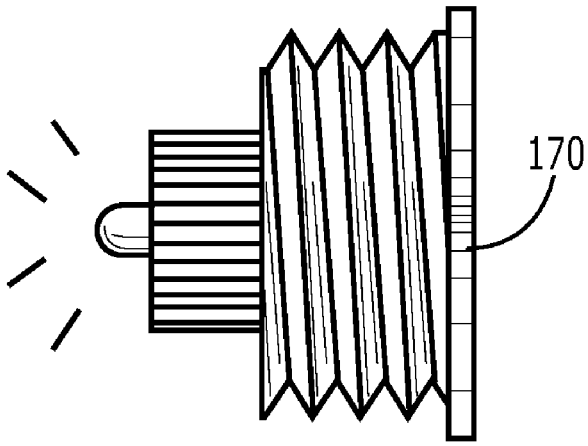
FIG. 1H illustrates one type of electric removable illumination device which may be utilized with embodiments of the present invention.
Figure 1I:
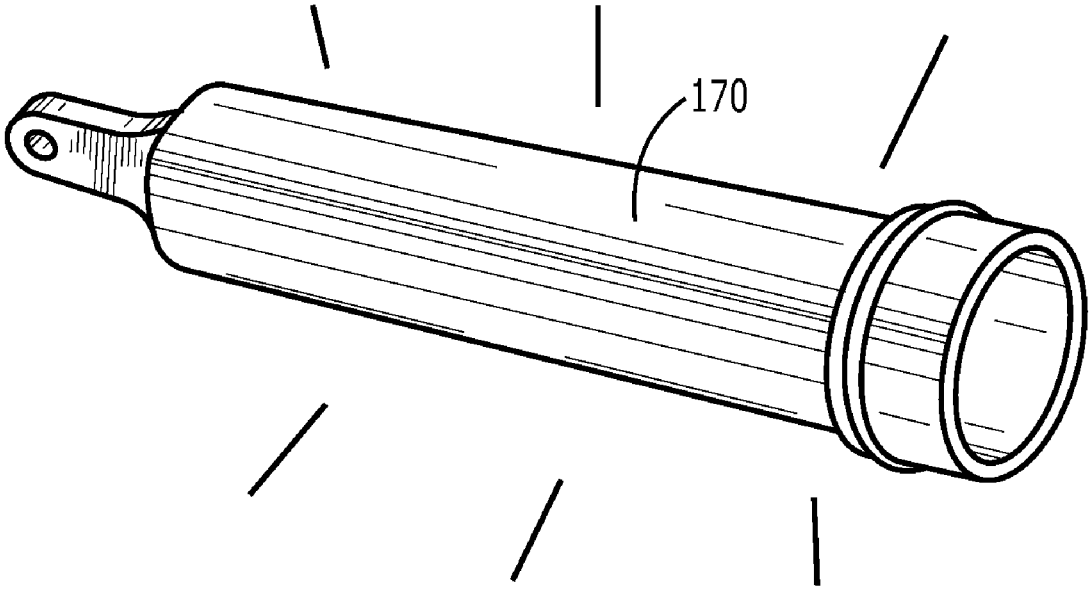
FIG. 1I illustrates one type of chemical removable illumination device which may be utilized with embodiments of the present invention.

Reference is next made to FIGS. 1H and 11, which illustrate perspective view of removable illumination devices, designated generally at 170. FIG. 1H illustrates an electrical battery operated type portable illumination device which may be disposed in the enclosure as the removable illumination device 170. The battery operated illumination device includes an electrical switching mechanism, output device, and a power source. Likewise, FIG. 1I illustrates a chemical type portable illumination device which may be disposed in the enclosure as the removable illumination device 170. The chemical illumination device includes a contained phosphorescent chemical.

Figure 2:
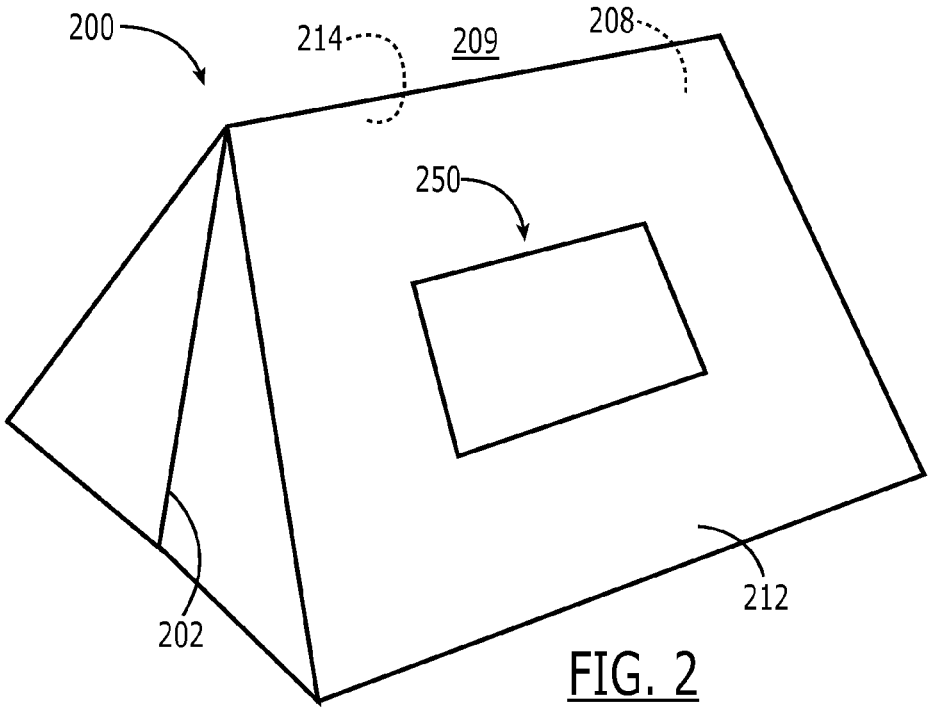
FIG. 2 illustrates a perspective view of an alternative portable article, including an interior/exterior illumination system in accordance with embodiments of the present invention.

Reference is next made to FIG. 2, which illustrates a perspective view of an alternative portable article including an interior/exterior illumination system, designated generally 200. The illustrated alternative portable article 200 is a tent or canopy that includes an interior/exterior illumination system 250 consistent with the embodiments described above for the luggage type portable article 100. The alternative portable article also includes an encasement member that substantially encases an interior region 208 from an exterior region 209. An internal surface 214 is adjacently disposed on the encasement member to the interior region 208. Likewise, an external surface 212 is adjacently disposed on the encasement member to the exterior region 208. The alternative portable article 200 includes a selectively passable doorway 202 which provides direct physical access to the interior region 208. The interior/exterior illumination system 250 is similarly configured to provide selective interior and exterior optical pathways between an enclosure (not visible) and the interior and/or exterior regions 208, 209.

Figure 3:
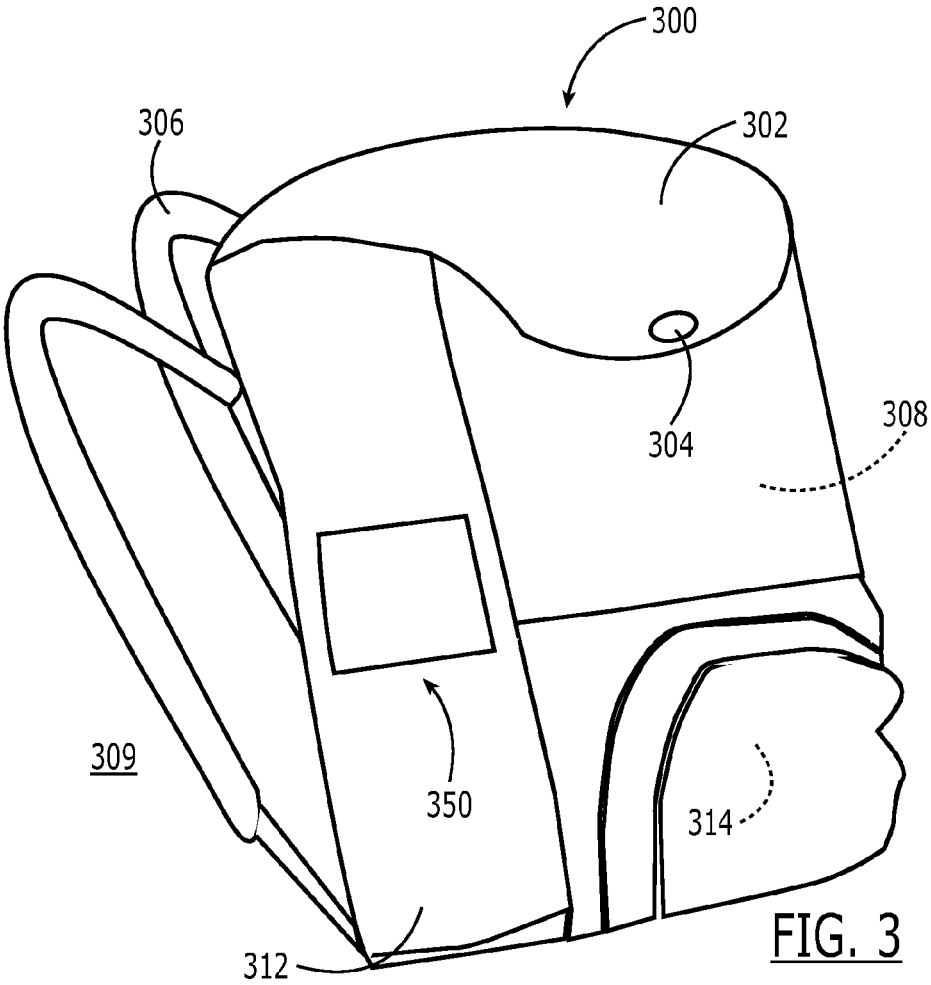
FIG. 3 illustrates a perspective view of an additional alternative article including an interior/exterior illumination system in accordance with embodiments of the present invention.

Reference is next made to FIG. 3, which illustrates a perspective view of an additional alternative article including an interior/exterior illumination system, designated generally 300. The illustrated alternative portable article 300 is a backpack that includes an interior/exterior illumination system 350 consistent with the embodiments described above for the luggage type portable article 100. The alternative portable article also includes an encasement member that substantially encases an interior region 308 from an exterior region 309. An internal surface 314 is adjacently disposed on the encasement member to the interior region 308. Likewise, an external surface 312 is adjacently disposed on the encasement member to the exterior region 308. The alternative portable article 300 includes a selectively passable flap 302 which provides direct physical access to the interior region 308. The flap 302 is releasably secured to the remainder of the encasement member via a button 304. The alternative portable article 300 includes two shoulder straps 306 which enable releasable coupling and support to a user. The interior/exterior illumination system 350 is similarly configured to provide selective interior and exterior optical pathways between an enclosure (not visible) and the interior and/or exterior regions 308, 309.

Various other embodiments have been contemplated, including combinations in whole or in part of the embodiments described above. For example, other types of portable articles substantially encasing an interior region from an exterior region may be utilized with a similar illumination system in accordance with embodiments of the present invention.

What is claimed is:

1. A portable article including an illumination system configured to selectively illuminate an interior and/or exterior region, comprising:

an encasement member substantially encasing an interior region from an exterior region, wherein the encasement member includes an internal surface adjacent to the interior region and an external surface adjacent to the external region;

an illumination system disposed on the encasement member comprising:

an enclosure disposed between an interior opening and an exterior opening of the encasement member, wherein the interior opening is within the internal surface, and wherein the exterior opening is within the external surface, and wherein the interior and exterior openings are respectively substantially covered by a first and second transparent member and a first and second opaque member; and wherein the first and second opaque members are selectively passable to optically unobstruct an optical pathway between the enclosure and at least one of the interior region and exterior region via the respective transparent members.

2. The portable article of claim 1, wherein the illumination system includes a removable illumination device disposed within the enclosure between the first and second transparent members, wherein the removable illumination device includes an illumination output.

3. The portable article of claim 2, wherein the removable illumination device includes an electrical power source.

4. The portable article of claim 1, wherein the encasement member is configured as a portable travel article including at least one of suitcase, backpack, briefcase, bag, and luggage.

5. The portable article of claim 1, wherein the encasement member is configured as a portable shelter article including at least one of a tent, canopy, and awning.

6. The portable article of claim 1, wherein the first and second opaque and transparent members are selectively passable from the interior and exterior openings to provide a physical pathway to the enclosure.

7. The portable article of claim 6, wherein the selectively passable configuration of the first and second transparent members includes at least one of selectively exposed recesses and partial releasable coupling.

8. The portable article of claim 1, wherein the selectively passable configuration of the first and second opaque members includes at least one of selectively exposed recesses and partial releasable coupling.

9. The portable article of claim 1, wherein the first and second opaque members include an inward surface adjacent to the enclosure and an outward surface opposite of the enclosure, and wherein the inward surface includes an optically reflective coating.

10. The portable article of claim 9, wherein the optically reflective coating of the first and second opaque members includes a yellow color.

11. A portable article including an illumination system configured to selectively illuminate an interior and/or exterior region, comprising:

an encasement member substantially encasing an interior region from an exterior region, wherein the encasement member includes an internal surface adjacent to the interior region and an external surface adjacent to the external region;

an enclosure disposed between an interior opening and an exterior opening of the encasement member, wherein the interior opening is within the internal surface, and wherein the exterior opening is within the external surface, and wherein the interior and exterior openings are respectively substantially covered by a first and second transparent member and a first and second opaque member; and a removable illumination device disposed within the enclosure between the interior and exterior openings, wherein the illumination device includes a selectable activation mechanism and an illumination output;

wherein the opaque and transparent members are selectively passable to provide a physical pathway to the enclosure; and wherein the first and second opaque members are selectively passable to optically unobstruct an optical pathway between the enclosure and at least one of the interior region and the exterior region via the respective transparent members.

12. The portable article of claim 11 further including a removable illumination device disposed within the enclosure between the first and second transparent members, wherein the removable illumination device includes an illumination output.

13. A method for selectively illuminating the interior and/or exterior regions of a portable article that substantially encases the interior region from the exterior region, comprising the acts of:

providing an encasement member substantially encasing an interior region from an exterior region, wherein the encasement member includes an internal surface adjacent to the interior region and an external surface adjacent to the exterior region;

providing an enclosure disposed between an interior and exterior opening of the encasement member, wherein the interior opening is within the internal surface, and wherein the exterior opening is within the external surface;

penetrably covering the interior and exterior openings with a first and second transparent member that provide respective optical pathways between the internal region and external region and the enclosure via the first and second transparent members;

penetrably covering the first and second transparent members with a first and second opaque member optically obstructing the optical pathways; and selectively penetrating at least one of the first and second opaque members from the respective opening and transparent member to optically unobstruct the respective at least one optical pathway.

14. The method of claim 13, wherein the act of penetrably covering the first and second transparent members with a first and second opaque member optically obstructing the optical pathways further includes disposing at least one of VELCRO, a zipper, and a button on the first and second opaque member thereby creating a selectively passable configuration with respect to the first and second transparent members.

15. The method of claim 13, wherein the act of penetrably covering the interior and exterior openings with a first and second transparent member that provide respective optical pathways between the internal region and external region and the enclosure via the first and second transparent members further includes disposing at least one of VELCRO, a zipper, and a button on the first and second transparent member thereby creating a selectively passable configuration.

16. The method of claim 13 further including the act of selectively penetrating at least one of the corresponding opaque and transparent members to provide a direct physical pathway to the enclosure from at least one of the exterior region and the interior region.

17. The method of claim 13 further including the act of disposing a removable illumination device within the enclosure between the first and second transparent members.

18. The method of claim 17 further including the act of selectively illuminating the removable illumination device thereby creating an illumination output that optically transmits through the selectively unobstructed at least one optical pathway.

19. The method of claim 18, wherein the act of selectively illuminating the removable illumination device includes selectively engaging an electrical switching mechanism to transmit electrical power from a power source to an optical output device.

20. The method of claim 13, wherein the act of selectively penetrating at least one of the first and second opaque members from the respective opening and transparent member to optically unobstruct the respective at least one optical pathway further includes folding the respective opaque member.

* * * * *